United States Patent [19]

Bellis et al.

[11] Patent Number: 4,718,474

[45] Date of Patent: Jan. 12, 1988

[54] MOLD TRANSFER MECHANISM FOR A MOLDING MACHINE

[75] Inventors: Kenneth E. Bellis, Rochester; Jackson E. Brown, Mt. Clemens; Pheroze J. Nagarwalla, Rochester Hills, all of Mich.

[73] Assignee: Roberts Corporation, Lansing, Mich.

[21] Appl. No.: 937,642

[22] Filed: Dec. 3, 1986

[51] Int. Cl.[4] ..... B22C 11/04; B22C 17/02

[52] U.S. Cl. ..... 164/158; 164/16; 164/159; 164/180; 164/228

[58] Field of Search ..... 164/16, 18, 37, 40, 164/44, 159, 169, 180, 137, 192, 193, 213, 228, 200–202, 158

[56] References Cited

U.S. PATENT DOCUMENTS

| | | | |
|---|---|---|---|
| 3,303,536 | 2/1967 | Pegon | 164/137 |
| 3,528,481 | 9/1970 | Lund | 164/200 X |
| 3,556,195 | 1/1971 | Lund | 164/16 |
| 4,588,014 | 5/1986 | Blower et al. | 164/159 X |

FOREIGN PATENT DOCUMENTS

| | | | |
|---|---|---|---|
| 55-36021 | 3/1980 | Japan | 164/16 |
| 58-53350 | 3/1983 | Japan | 164/180 |
| 1352562 | 5/1974 | United Kingdom | 164/16 |

*Primary Examiner*—Nicholas P. Godici

*Assistant Examiner*—J. Reed Batten, Jr.

*Attorney, Agent, or Firm*—Thomas K. Ziegler; Raymond J. Eifler

[57] ABSTRACT

A machine for making molds and molding cores (126) includes a pair of mold boxes (42*a*, 42*b*) removably mounted on a frame (60) for rotation between an upright, molding position in which molding mateiral is introduced into the molding cavity of the molding boxes (42*a*, 42*b*) by a carrier (26) and an inverted discharge position in which the mold (126) is removed from the boxes by a mold receiving assembly (76). A pressure head assembly (46) both compresses molding material within the molding cavity and introduces a catalyst gas into the cavity for curing the molding material. A system for removing the spent gas from the molding cavity includes a pair of gas receiving chambers (122*a*, 122*b*) integral with the frame (60) which receives gas through the bottom of the mold boxes (42*a*, 42*b*) and an exhaust assembly (68, 70) which is selectively coupled with exhaust ports (124*a*, 124*b*) in the chambers (122*a*, 122*b*). A mold transfer carriage (84) transfer molds (126) discharged from the mold boxes (42*a*, 42*b*) to either of two lateral positions and can be employed to automatically change mold boxes (42*a*, 42*b*) which are mounted on the frame (60) by quick release connections (62, 64, 134).

19 Claims, 14 Drawing Figures

MOLD TRANSFER MECHANISM FOR A MOLDING MACHINE

The present invention broadly relates to molding machines for producing molds or cores, and deals more particularly with a molding machine having a mold transfer mechanism which transfers a finished mold away from a mold box after the mold has been removed from the box.

One type of molding machine which is particularly well suited for making molds and cores from sand or similar material employs at least one and preferably two molds boxes which are mounted on a turret for rotation between an upright, molding position in which molding material is introduced into and compressed within the mold, and an inverted discharge position in which the finished mold is vertically removed from the box. A molding machine of the type mentioned above is disclosed in detail in U.S. Pat. No. 3,348,606 entitled "Molding Machine Transfer Mechanism" issued Oct. 24, 1967. The previously mentioned patent also discloses a mechanism for transferring the finished mold after it has been discharged from an inverted mold box. The transfer mechanism includes a vertical elevator which receives the mold from an inverted box and lowers it away from the box onto a horizontal conveyor. The horizontal conveyor then transfer the mold laterally in one direction to an outboard position where the mold can be removed from the machine, either manually or by a robotic mechanism.

The machine described in the patent mentioned above, while entirely satisfactory for its intended purpose, is subject to improvement particularly with respect to the productivity achievable by the machine. For example, because of the design of the mold transfer mechanism, it was possible to transfer a finished mold horizontally to only one side of the machine. This limited production flexibility and efficiency in that molds could only be removed from one side of the machine. Moreover, the horizontal conveyor was of a chain driven type and rather complicated in design, consequently such conveyor was relatively costly to manufacture.

The productivity of prior art molding machines as described above was limited somewhat by the fact that the mold boxes, which were uniquely configured to produce a particular part, had to be manually removed and installed from the machine. Manual installation and removal of the mold boxes was rather time consuming and contributed to the down time.

Finally, productivity of the prior machines was further limited due to the fact that it was necessary to manually clean the mold boxes of residual molding material before the boxes were used to make a subsequent mold. Such cleaning usually necessitated the machine operator wiping or blowing the mold face and mold cavity by hand.

SUMMARY OF THE INVENTION

This invention provides a mold transfer mechanism for a molding machine which significantly increases productivity. The machine is of the type having at least one mold box provided with a mold cavity for forming a mold therein and means for mounting the mold box on a frame for rotation of the mold box between an upright, molding position and an inverted mold discharge position. The mold transfer mechanism includes an elongate mold transfer carriage positioned below the mold box and which includes first and second sections for respectively supporting first and second molds or mold boxes thereon. Means are provided for transferring a mold from an inverted mold box to one of the first and second sections of the mold transfer carriage. The mold transfer mechanism further includes means for shifting the mold transfer carriage along its longitudinal axis between a first position in which the first section of the transfer carriage is disposed beneath an inverted mold box and the second section is disposed in a first laterally outboard position, and a second position in which the first section of the mold transfer carriage is disposed in a second laterally outboard position and the second section is disposed beneath the inverted mold box. The mold transfer carriage includes a plurality of apertures therein which register with mold supporting elements which are shiftable vertically through the apertures and are employed to lower a finished mold from an inverted box onto the mold transfer carriage. Means are provided on the mold transfer carriage for automatically cleaning away residual molding material from the inverted mold box as the mold transfer carriage is shifted between its first and second positions.

Accordingly, one advantage of this invention lies in a mold transfer mechanism for a molding machine which increases productivity and manufacturing flexibility by transferring a finished mold to either of two, laterally spaced outboard positions on the machine.

Another advantage of this invention lies in a mold transfer mechanism as described above which is especially simple and rigid in design and therefore not only less costly to manufacture but offers improved reliability.

Another advantage of this invention is to provide a mold transfer mechanism of the type mentioned above which is suitable for use in automatically installing and removing mold boxes from the molding machine.

Another advantage of this invention is to provide a mold transfer mechanism as described above which includes means for automatically cleaning a mold box of residual molding material.

BRIEF DESCRIPTION OF THE DRAWINGS

Referring now to the drawings, FIGS. 1 and 2 illustrate a machine generally indicated by the numeral 20 for forming molds. The molds may be an end product, or may be "cores" which are employed in subsequent molding and casting processes. The machine 20 includes a supporting frame comprising upright frame members 25 joined together by horizontal frame members 27. A mold box frame 60 is mounted for rotation about an essentially horizontal axis by means of trunnions 21 which in turn are secured to the horizontal frame members 27. The frame 60 is rotated by means of a conventional rotary actuator 66 which is mounted on a bracket 93.

Figure 1:
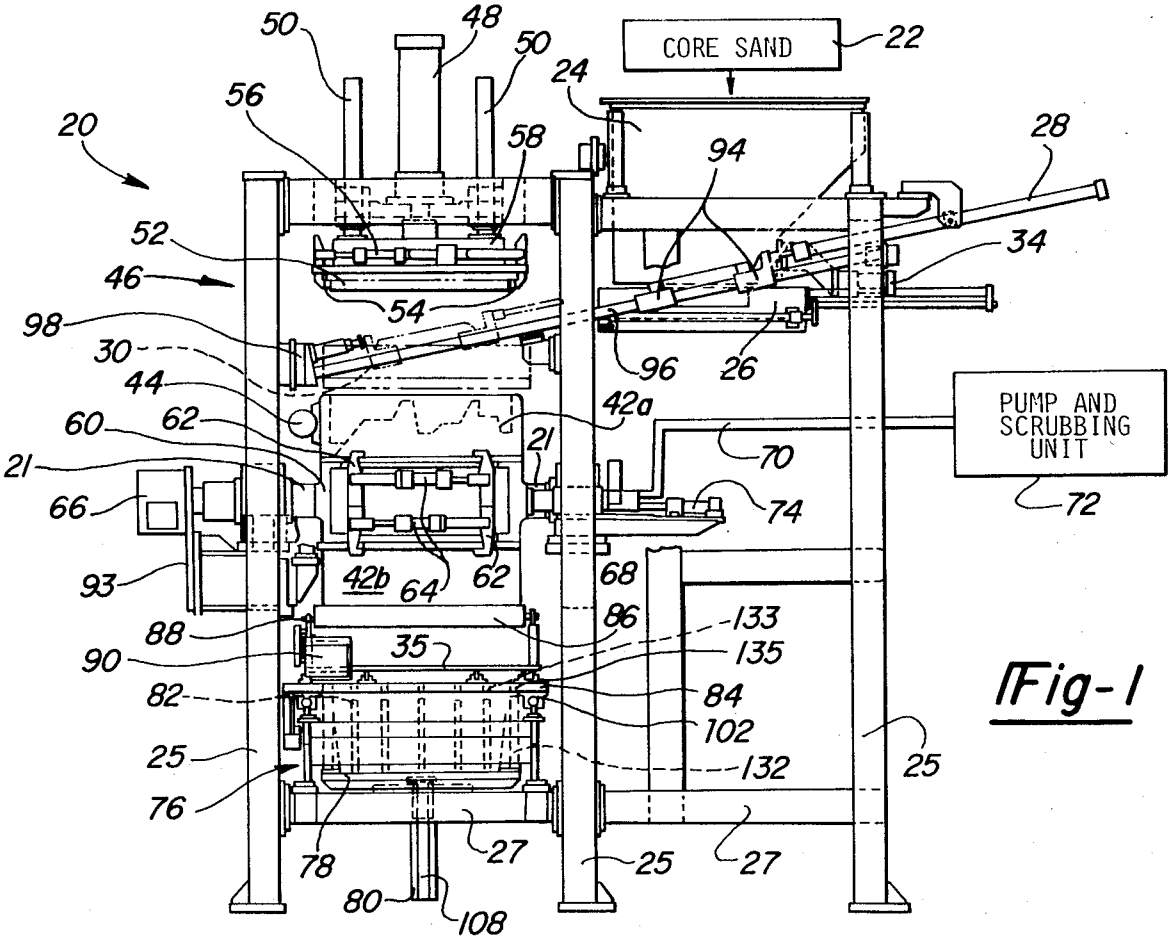
FIG. 1 is a front elevational view of a machine for making molds which forms the preferred embodiment of the present invention, the operating position of the sand carrier being indicated in the phantom.

Mounted on opposite sides of the frame 60 are a pair of mold boxes 42*a*, 42*b*, each having a mold cavity configured to form the desired mold or core. The mold boxes 42*a*, 42*b* are releasably mounted on the frame 60 by means of a quick release mechanism comprising clamps 62 which are individually controlled by hydraulic cylinders 64. A conventional vibrator 44 may be mounted on each of the mold boxes 42*a*, 42*b* for the purpose of vibrating the corresponding mold box to encourage settling and compacting of molding material therein.

As will be discussed later, the frame 60 is in the form of a housing having exhaust chambers therein which may be connected with an exhaust line 70 by means of an exhaust coupling 68. The exhaust coupling 68 is positioned laterally of the frame 60 and is reciprocated horizontally by means of a hydraulic cylinder 74, between a standby position in which the frame 60 is free to rotate, and an operating position in which the exhaust coupling 68 is connected with the frame 60 when the latter is stationary. The exhaust line 70 is connected with a pump and scrubbing unit 72 of conventional design which draws spent exhaust gas from the frame 60.

Figure 2:
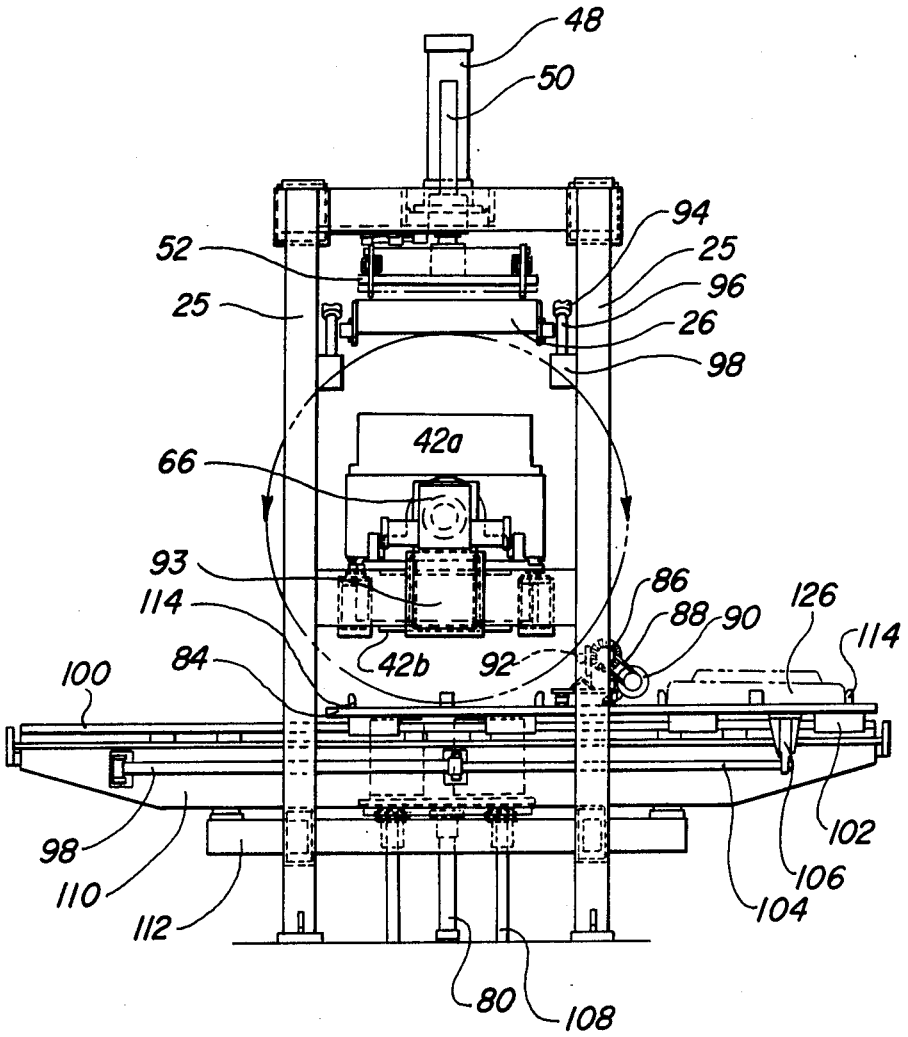
FIG. 2 is a side elevational view of the machine shown in FIG. 1.

As will be discussed below, the tops of the mold boxes 42*a*, 42*b* are open so as to allow molding material to be introduced therein and to permit a finished mold or core to be removed therefrom. The mold boxes 42*a*, 42*b* are each rotatable along with the frame 60 from an upright, molding position to an inverted, discharge position. As shown in FIGS. 1 and 2, the mold box 42*a* is in the molding position thereof and the mold box 42*b* is in the discharge position thereof.

Mounted on the frame members 25, 27 is a hopper 24 into which molding material such as sand is introduced from a source 22 thereof. The sand or other molding material includes a binding agent of a conventional type which can be activated by a catalyst gas to bind the sand and thereby form a mold or core. A hydraulic cylinder 34 controls a later discussed gate to allow sand to flow from the bottom of the hopper 24 into a sand carrier 26. The sand carrier 26 is mounted for inclined lateral movement between a standby position as shown in FIG. 1 in which sand may be introduced therein from the hopper 24 to an operating position immediately above the mold box 42*a*. The sand carrier 26 is mounted on a pair of inclined guide rods 96 secured to bracket 98, by means of bushings 94. The sand carrier 26 is driven between its operating and standby positions by a hydraulic cylinder 28.

Mounted immediately above the rotating frame 60 is a pressure head assembly generally indicated by the numeral 46. The pressure head assembly 46 includes a manifold head 58 driven for vertical reciprocation by a hydraulic cylinder 48 and guided in its vertical movement by guide rods 50. A gassing/press plate 52 is removably mounted on the bottom face of the manifold head 58 by means of a quick release mechanism comprising clamps 54 which are controlled by hydraulic cylinders 56.

Disposed beneath the rotating frame 60 is a horizontally extending support table 110 which extends laterally beyond the upright frame members 25, as best seen in FIG. 2. The support table 110 is in turn mounted on a cross frame 112 which is secured to the upright frame members 25. A pair of spaced apart guide rods 100 are secured to the upper face of the support table 110. A horizontal mold transfer carriage 84 which may comprise a plate is mounted on the guide rods 100 by means of bushing assemblies 102 so as to move laterally beneath the rotating frame 60. The transfer carriage 84 is driven on the guide rods 100 by means of a hydraulic cylinder 98 having an output piston rod 104 connected to the carriage 84 by a bracket 106. Mounted on the upper face of the transfer carriage 84 are two sets of locating pins 114 whose purpose will be described below. The transfer carriage 84 has a length sufficient to define two sections which respectively accommodate two molds or cores: one mold 126 disposed on one section of the carriage 84 immediately beneath the rotating frame 60, and the other mold 126 disposed laterally outboard on the second section of the carriage 84 so that access may be had to the outboard mold while a subsequently formed mold is being deposited on the transfer carriage 84.

Mounted on the upper surface of the transfer carriage 84, between the two sets of locating pins 114 is a support bracket 35. A cylindrical brush 86 is mounted for rotation on the bracket 35 and is driven by a conventional motor 90 via a belt 88. Also mounted on the bracket 35 is an air distribution pipe 92 which is connected with a suitable source of pressurized air (not shown) and includes upwardly facing apertures (not shown) therein so that compressed air flows upwardly from the pipe 92, along essentially its entire length.

Positioned below the transfer carriage 84 is a mold receiving and transfer assembly generally indicated by the numeral 76. The mold receiving and transfer assembly 76 includes a support 78 driven for vertical reciprocation by a hydraulic cylinder 80 and guided in its vertical movement by rods 108. Mounted on the upper face of the support 78 are a plurality of vertically extending essentially U-shaped mold support fingers 82. Also mounted on the upper face of the support 78 are a plurality of mold box support arms 132 which are adapted to engage and support each of the mold boxes 42*a*, 42*b* during changeover of such mold boxes, as will be discussed later in more detail. The transfer carriage 84 includes a plurality of elongate openings 133 therein which register with the fingers 82 and which register with support arms 132 so that the fingers 82 and support arms 132 may pass upwardly through the carriage 84.

The control system for operating the various parts of the machine 20 is of a conventional design and may be of the general type, for example, disclosed in U.S. Pat. No. 3,348,606, consequently, the details of such a system need not be discussed herein.

Figures 3, 4:
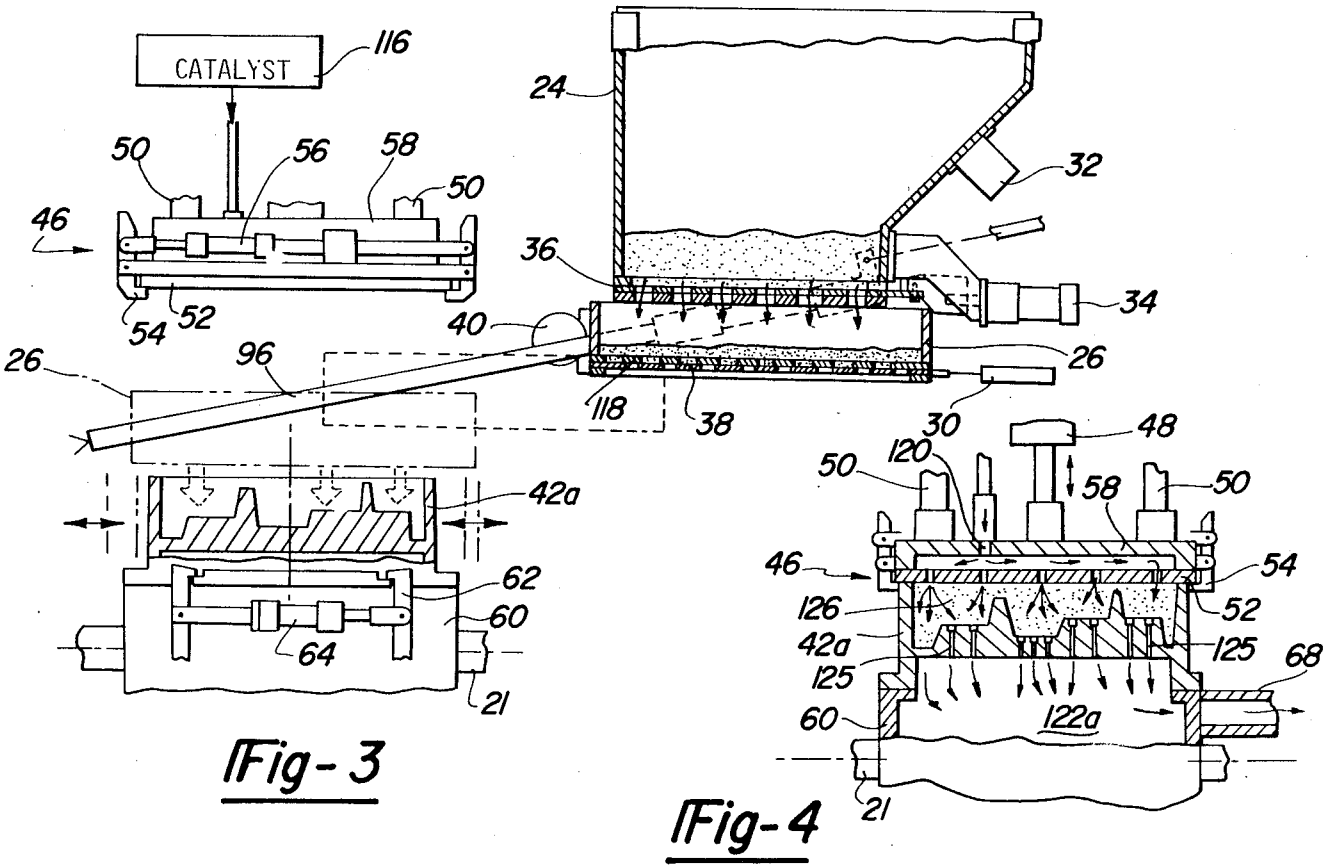
FIG. 3 is a fragmentary, sectional view showing the sand carrier in operative relationship to the press head assembly and mold box.
FIG. 4 is a fragmentary, sectional view depicting the press head assembly in an operating position and showing the flow path of the activating gas.

FIG. 3 illustrates the hopper 24 and sand carrier 26 in more detail. Sand introduced into the top of the hopper 24 is drawn to the bottom thereof by the influence of gravity, aided by a suitable vibrator 32 mounted on the wall of the hopper 24. The bottom of the hopper 24 is perforate and includes a hopper gate 36 controlled by the hydraulic cylinder 34 to allow sand in the hopper 24 to flow into the generally rectangular sand carrier 26. A vibrator 40 is mounted on a sidewall of the sand carrier 26 to aid in discharging sand from the carrier 26 into the mold cavity of a mold box such as mold box **42*a* disposed in the molding position thereof. The sand carrier 26 includes a perforate bottom wall 118 beneath which there is provided a sand carrier gate plate 38 which is controlled by hydraulic cylinder 30. The manifold head 58 is coupled with a source of catalyst gas 116**.

FIG. 4 illustrates the operation of the pressure head assembly 46 during the pressing and gassing operation. The catalyst gas from the source 116 flows into the hollow interior of the manifold head 58 and then outwardly through apertures in the plate 52 into the mold cavity of the mold box **42*a*. The bottom of each of the mold boxes 42*a*, 42*b* includes a plurality of passageways 125 therein which place the mold cavity in gas flow communication with exhaust chambers in the frame 60, one of such chambers being designated by the numeral 122*a* in FIG. 4**.

Figure 5:
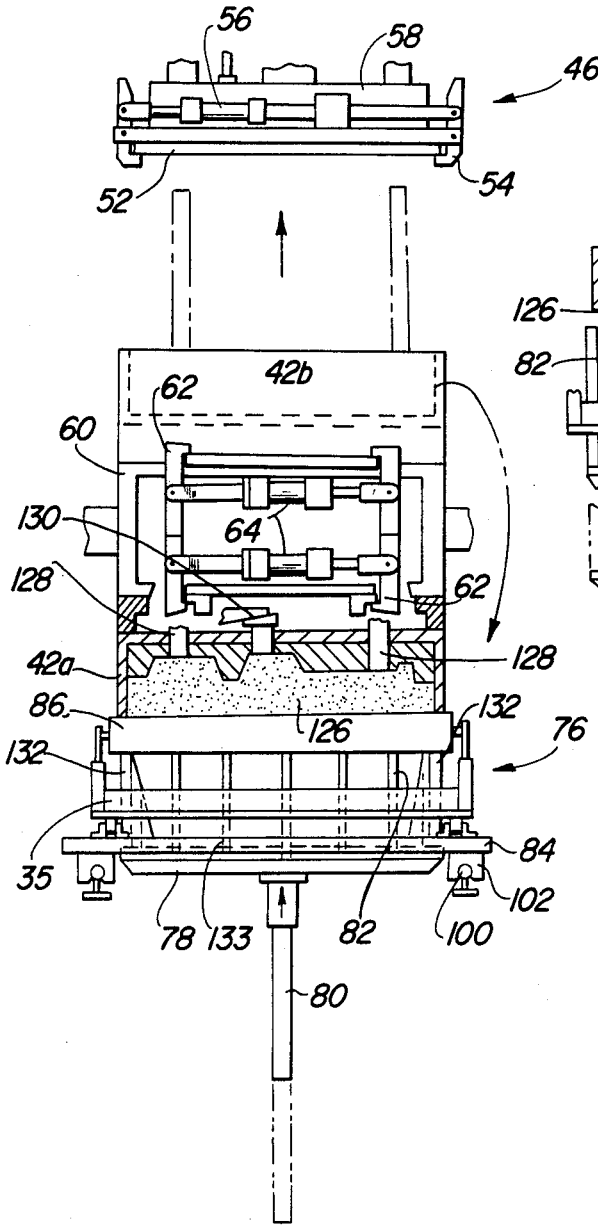
FIG. 5 is a front view, partially in section, of a portion of the machine and depicting a mold being discharged from a mold box.

FIG. 5 depicts the frame 60 having been rotated 180 degrees so that the mold box **42*a* is in its inverted, discharge position. FIG. 5 also depicts an ejection mechanism for ejecting the mold 126 from the box 42*a*. Various types of ejector assemblies may be satisfactorily employed, one such ejector system being shown in U.S. Pat. No. 3,348,606 mentioned hereinabove. Thus, it is not necessary to disclose the details of such an ejector assembly herein. However generally, such an assembly will include a plurality of ejector pins 128 which are actuated by a cam assembly 130 for example, and which extend through the bottom of the molding box 42*a* so as to engage the mold 126 and force the latter downward while the mold 126 is supported by the mold supporting fingers 82**.

Figure 6:
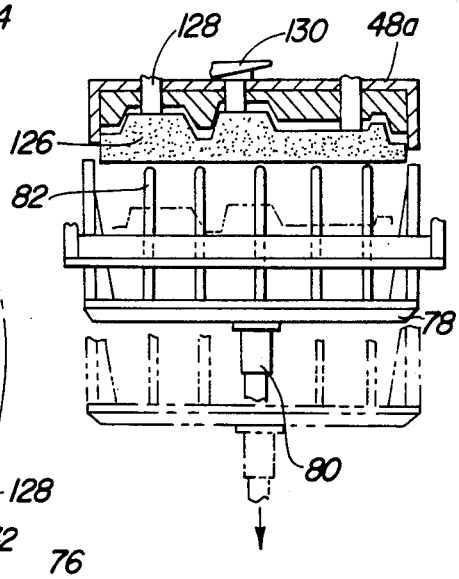
FIG. 6 is a view similar to FIG. 5 but at a later interval during the discharge of the mold.

As shown in FIG. 6, the downward movement of the support 78 and fingers 82 is synchronized with the displacement of the ejector pins 128 so that the mold 126 has ejection pressure evenly supplied thereto while being supported at all times by the fingers 82.

Figure 7:
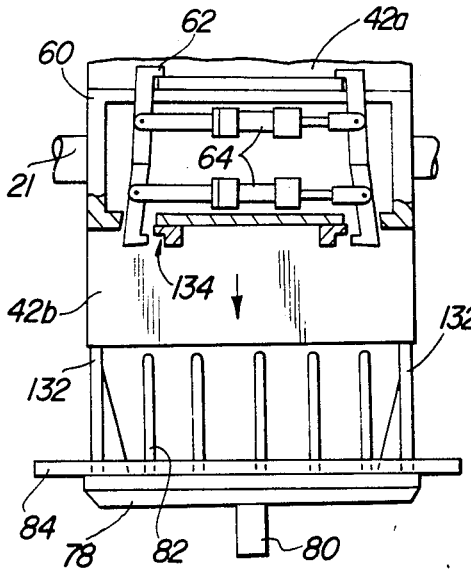
FIG. 7 is a fragmentary, front elevational view of a portion of the machine depicting an initial step in removing a mold box from the rotating frame.
Figure 8:
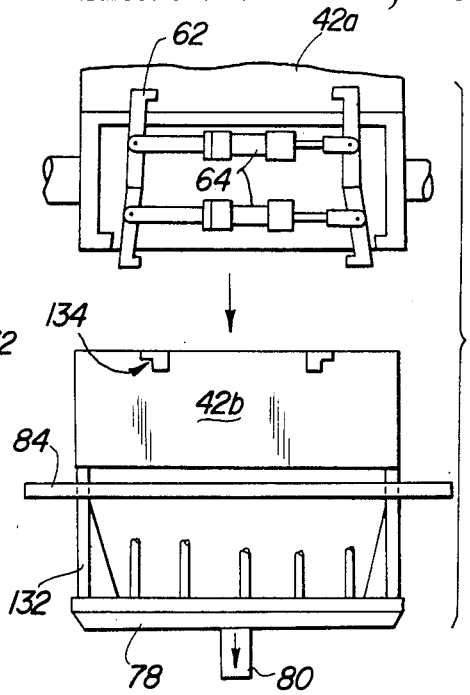
FIG. 8 is a view similar to FIG. 7 but depicting a mold box being lowered onto the transfer carriage.

FIGS. 7 and 8 illustrate the manner in which the mold boxes **42*a*, 42*b* can be removed from the rotating frame 60. Each of the mold boxes 42*a*, 42*b* is provided with a locking member 134 which matably engages with the clamps 62. The clamps 62 are disengaged and shifted free of the locking members 134 by means of the hydraulic cylinder 64. Prior to releasing a mold box 42*b* while the latter is in the discharge position thereof, the support 78 is elevated until the support arms 132 contact the bottom of the mold box 42*b*. FIG. 8 depicts the support 78 as having been lowered so as to lower the mold box 42*b* onto the transfer carriage 84**.

Figure 9:
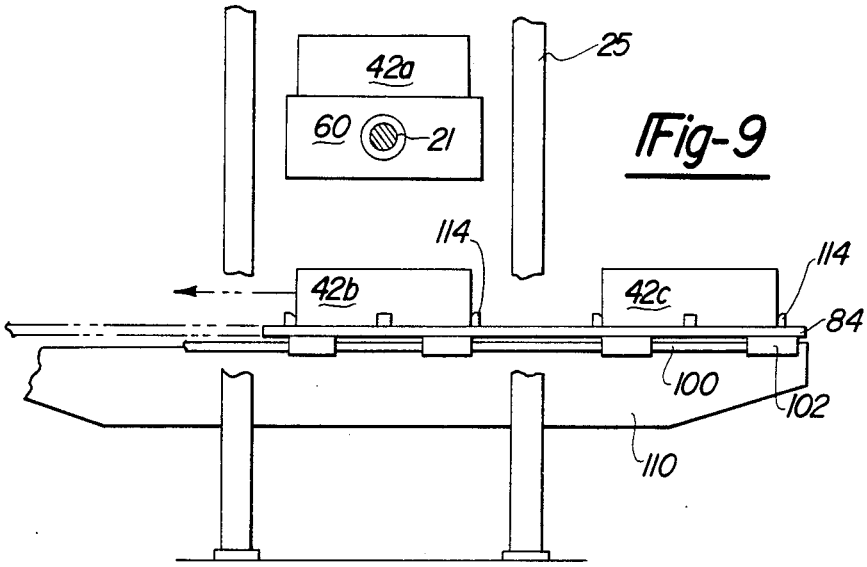
FIG. 9 is an essentially diagrammatic frontal view of the machine during changing of the mold boxes.

FIG. 9 depicts the mold box **42*b* as having been lowered onto the transfer carriage 84. The mold box 42*b* is received within the locating pins 114. A third mold box 42*c* is positioned on one end of the transfer plate 84 in a preselected position determined by the locating pins 114**.

Figure 11:
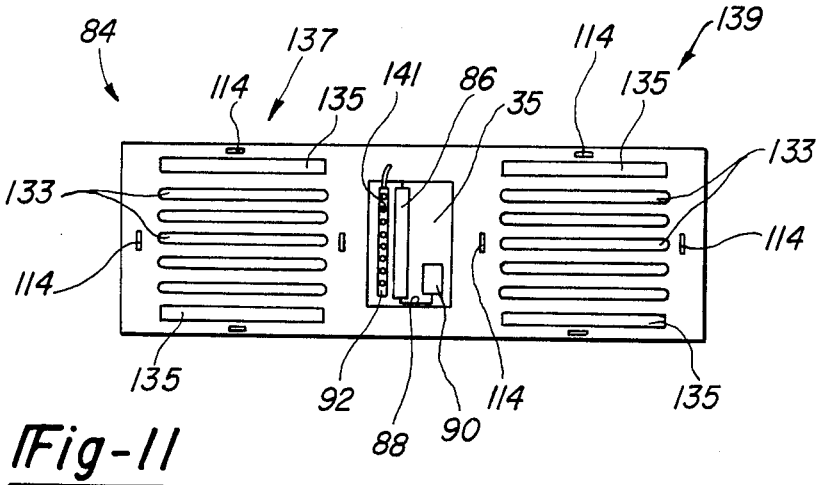
FIG. 11 is a plan view of the mold transfer carriage.

FIG. 11 illustrates the details of the mold transfer carriage 84. The carriage includes first and second longitudinally spaced sections 137 and 139 respectively upon each of which a mold (not shown) or a mold box (not shown) can be supported. Each section 137, 139 of the carriage 84 includes a first set of longitudinally extending elongate openings 133 therein through which the mold support fingers 82 (FIG. 1) may extend, as well as a second set of outboard, longitudinally extending openings 135 through which the mold support arms 132 (FIG. 1) may extend. The brush 86 and air pipe 92 extend parallel to each other and transverse to the path of travel of the carriage 84. The air pipe 92 is shown as having spaced apart, upwardly facing apertures 141 therein through which pressurized air may pass.

Figure 10:
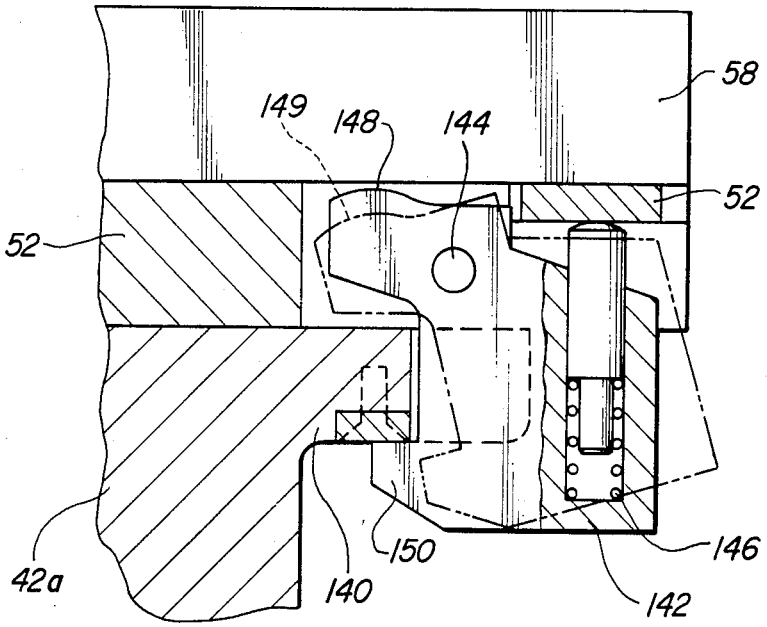
FIG. 10 is an enlarged, fragmentary view, taken partially in section and showing a mechanism for automatically clamping the gassing/press plate on a mold box.

FIG. 10 depicts the details of a mechanism for releasably clamping the gassing/press plate 52 to the top of one of the core boxes, such as core box **42*a*. A plurality of clamping members 142 are pivotally mounted by means of corresponding pivot pins 144 around the periphery of the gassing/press plate 52. Each of the clamping members 142 includes a hook portion 150 which is adapted to engage the bottom side of a peripheral shoulder 140 of the mold box 42*a*. The clamping members 142 also include a camming surface 148 which is adapted to be engaged by a downwardly extending cam button 149 on the bottom of the gassing/press plate 52. A spring assembly 146 is provided for normally biasing the clamping member 142 to pivot clockwise as viewed in FIG. 10**.

Figure 12:
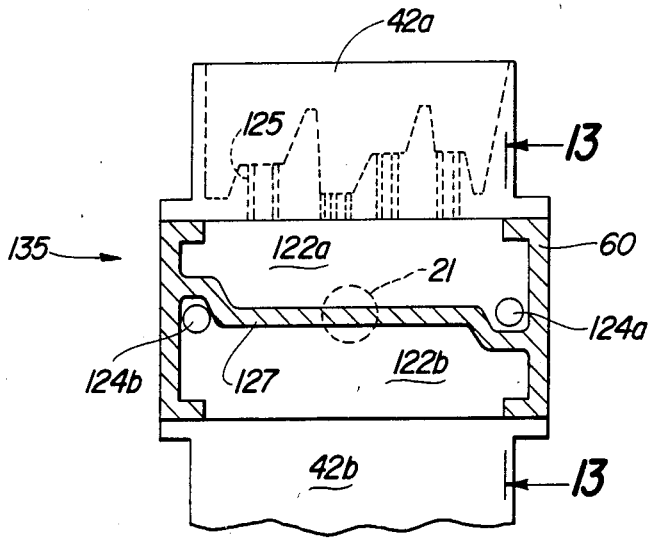
FIG. 12 is a sectional view of the frame depicting the exhaust chambers in operative relationship to the corresponding mold boxes.
Figure 13:
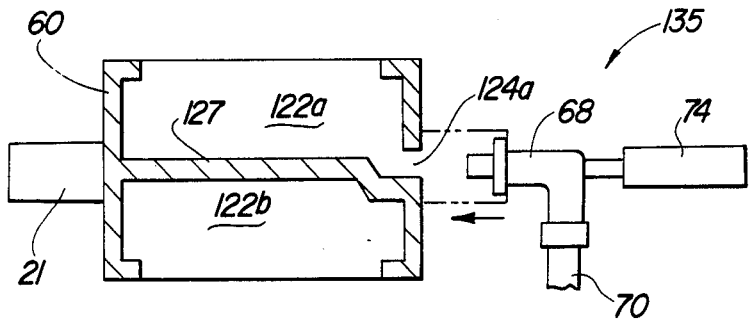
FIG. 13 is a sectional view taken along the line 13—13 in FIG. 12.

FIGS. 12 and 13 depict the details of a means 135 for removing spent gas from the mold cavities of the mold boxes **42*a*, 42*b*. The gas removing means 135 includes a pair of exhaust chambers 122*a*, 122*b* defined in the housing-like rotating frame 60. The exhaust chambers 122*a*, 122*b* are separated by a partition 127. The bottom faces of the mold boxes 42*a*, 42*b* form one wall of the corresponding exhaust chambers 122*a*, 122*b*. The mold cavities of the mold boxes 42*a*, 42*b* communicate with the corresponding chambers 122*a*, 122*b* by means of passageways 125 in the bottom of the corresponding mold boxes 42*a*, 42*b*. The frame 60 includes a pair of lateral exhaust ports 124*a*, 124*b* which communicate with the associated chambers 122*a*, 122*b*. These exhaust ports 124*a*, 124*b* are equally radially spaced from the axis of the trunnion 21 so that they trace the same circular path upon rotation of the frame 60. The gas exhaust coupling 68 is positioned on one side of the frame 60 and at a position radially spaced from the axis of the trunnion 21 so as to be aligned with the rotational path of the ports 124*a*, 124*b* associated with the mold boxes 42*a*, 42*b* which are disposed at the upright molding position thereof. The hydraulic cylinder 74 shifts the exhaust coupling 68 from a standby position to an operating position in which the exhaust line 70 is connected with the corresponding exhaust chamber 122*a*, 122*b***.

Figure 14:
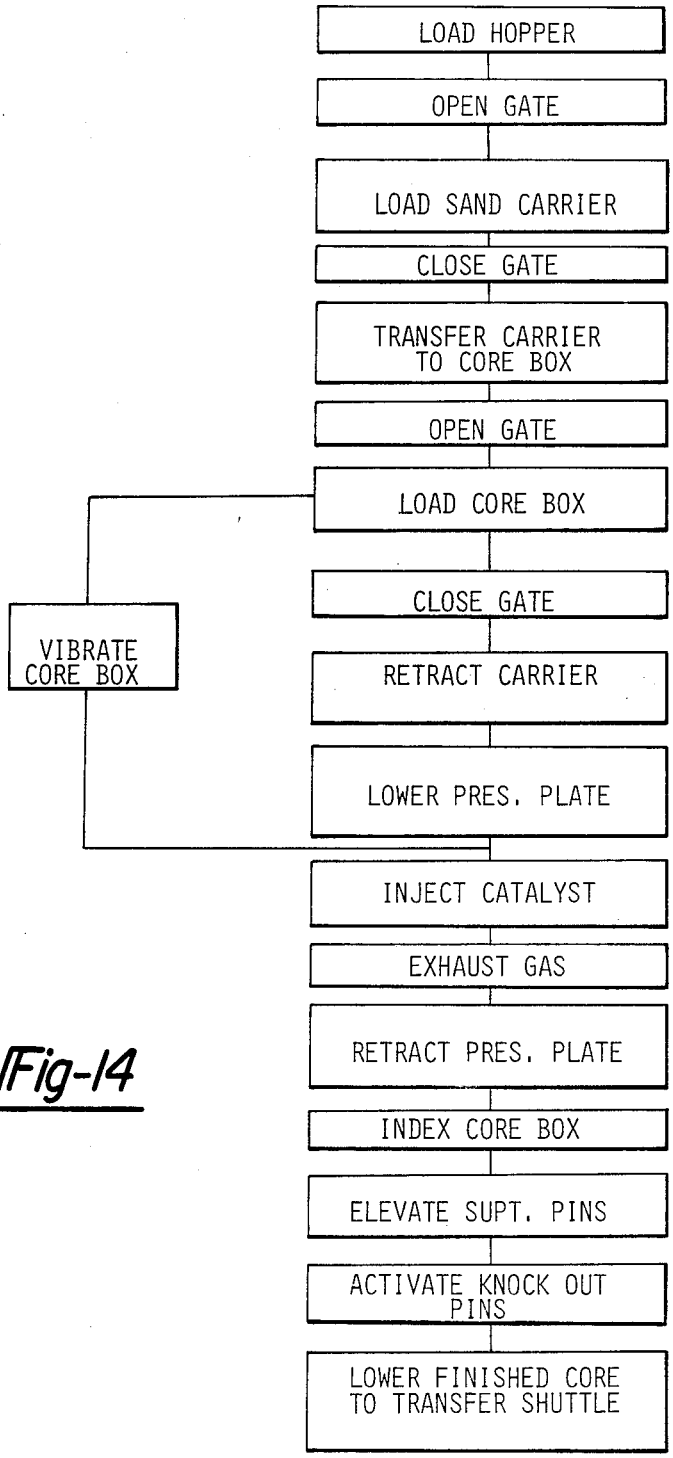
FIG. 14 is a flow chart of the steps in the operation of the machine.

FIG. 14 depicts the steps involved in a typical molding operation which will be discussed below in connection with a description of the operation of the machine.

OPERATION

Referring to FIGS. 1, 2 and 3, sand is first loaded into the hopper 24 following which the hopper gate 36 is opened by the cylinder 34 to place a charge of sand in the carrier 26. The hopper gate 36 is then closed. The cylinder 28 is actuated to move the carrier 26 from its normal, standby position to an operating position disposed immediately above the mold box 42*a*. With the sand carrier positioned immediately above the mold box 42*a*, cylinder 30 is actuated to open the carrier plate 38 and allow sand within the carrier to fall into the open mold cavity of the mold box 42*a*. The vibrator 40 may be energized to increase the flow of sand from the carrier 26 into the mold box 42*a*. While the mold box 42*a* is being loaded with sand from the carrier 26, the vibrator 44 may be energized to vibrate the mold box 42*a* and thereby aid in the settling and compacting of the sand therewithin. Typically, the entire mold cavity of the mold box 42*a* is filled and preferably, the deposited sand may extend slightly above the top of the mold box 42*a*. The carrier plate gate 38 is then closed and the carrier 26 is retracted from its operating position to its standby position.

The pressure head assembly 46 is then lowered as shown in FIG. 4 until the gassing/press plate 52 engages the sand extending above the top of the mold box 42*a* and forces the sand downwardly thereby compacting the sand to some extent within the mold cavity. With the sand within the mold cavity having been compacted, catalyst gas from the source 116 then flows into the manifold head 58 and out through the openings in the gassing/press plate 52 and into the mold cavity. As discussed above, the catalyst gas functions to activate the binder which has been mixed with the sand thereby resulting in the sand becoming bound together to form a mold or core.

Referring to FIGS. 1, 12 and 13, the cylinder 74 is activated to shift the exhaust coupling 68 into the exhaust port 124*a*. The pump and scrubbing unit 72 is activated in order to create a partial vacuum in the exhaust chamber 122*a*. This partial vacuum functions to draw spent gas in the mold cavity downwardly through the passageways 125 into the exhaust chamber 122*a* and then through the port 124*a* into the exhaust line 70. The spent gas is then cleansed by a conventional scrubbing unit 72.

After a sufficient quantity of gas has been introduced into the mold cavity, the pressure head assembly 46 is retracted to its elevated position and the frame 60 is rotated 180° so that the mold box 42*a* having the finished mold 126 therein is positioned in an inverted discharge position and the empty mold box 42*b* is positioned in the upright, molding position, as shown in FIG. 5. Referring now to FIG. 5, the support plate 78 is moved upwardly until the fingers 82 engage or are in close proximity to the mold 126. The ejector pins 128 are then actuated to force the mold 126 downwardly. Simultaneous with the actuation of the ejector pins 128, the support plate 78 is moved downwardly in synchronism with the downward movement of the ejector pins 128 so that the mold 126 is supported at all times while it is being ejected from the mold cavity. The support plate 78 continues its downward movement until the mold 126 comes to rest on the transfer carriage 84. With the mold 126 resting on one end of the transfer plate 84, the cylinder 98 is actuated to shift the transfer plate 84 in one direction along the guide rod 100. It should be noted here that since the transfer plate 84 is sufficiently long to accommodate two molds 126, the ejected mold may be transferred either to the left or to the right side of the machine 20. FIG. 2 depicts the position of the transfer plate 84 after it has transferred a mold 126 to the right side of the machine 20. The mold 126 is then removed either manually or with suitable automatic handling equipment. Note also, as shown in FIG. 2 that the left end of the transfer plate is readied beneath the rotating frame 60 in preparation for receiving the next mold 126. Thus, it is not necessary to delay forming the next mold and ejecting it onto the transfer plate until the previous mold has been removed from the transfer plate 84.

Referring particularly to FIGS. 1 and 2, it is highly desirable to clean the outer face of a mold box 42*a*, 42*b* after a mold 126 has been formed therein and discharged therefrom. This cleaning operation is performed by the brush 86 and air pipe 92. After a mold 126 has been discharged from the inverted mold box 42*b*, the motor 90 is energized thereby turning the brush 86. As the transfer plate 84 moves along the guide rods 100, the rotating brush 86 comes in contact with and brushes or sweeps away material on the face of the core box 42*b*. At the same time, pressurized air exiting from the air pipe 92 blows into the mold cavity thereby assisting in removing residual sand therefrom. During the interval in which a mold 126 is being discharged from an inverted mold box 42*a* the molding process is repeated for the molding box 42*b* which is in the upright, molding position. It may thus be appreciated that the machine 20 maximizes productivity.

In addition to automatically forming and removing molds 126, the machine is also capable of automatically changing tooling consisting of the gassing/press plate 52 and the mold boxes 42*a*, 42*b*. This mode of operation is depicted in FIGS. 7, 8 and 9. When it is desired to change or replace one of the mold boxes 42*a*, 42*b* such box is first rotated to its inverted, discharge position, as shown in FIG. 7. The cylinders 64 are then activated to release the clamps 62 from the locking members 134. Prior to unlocking the clamps 62, the plate 78 is moved upwardly until the support arms 132 contact and support the core box 42*b*. After the clamps 62 have been unlocked, the support plate 78 is moved downwardly until the core box 42*b* engages and comes to rest on the top of the transfer plate 84. As shown in FIG. 9, with the core box 42*b* positioned on one end of the transfer plate 84, the latter may be moved to the left to position a new mold box 42*c* in registered relationship immediately beneath the rotating frame 60. The support plate 78 is again elevated until the support arms 132 engage the bottom face of the new mold box 42*c*. Continued upward movement of the support plate 78 moves the new mold box 42*c* into position in engagement with the rotating frame 60. The corresponding hydraulic cylinder 64 is then activated to move the clamps 62 into locking relationship with the locking members 134, thereby securing the new mold box 42*c* in place. With the new mold box 42*c* in place, the frame 60 is rotated 180° and the mold box 42*a* is removed in a manner similar to that described above with respect to mold box 42*b*. After at least one of the mold boxes 42*a*, 42*b* have been removed from the transfer plate 84, a fourth mold box (not shown) is placed on the transfer plate in a preselected position determined by the locater pins 114. The transfer plate 84 is then shifted until the fourth mold box is positioned beneath the frame 60. The fourth mold box is mounted on the frame 60 in the manner described above with respect to mold box 42*c*.

Referring now to FIGS. 1, 2 and 10, in some cases it may be desirably or necessary to replace the gassing/press plate 52 with another of such plates that may be differently configured. This can be automatically performed by the machine 20 of the present invention by lowering the press head assembly 46 until the plate 52 engages the top of one of the mold boxes 42*a* and the buttons 149 engage the cam surface 148 to open the clamps 142. The cylinder 56 is then activated to release the clamps 54 which hold the plate 52 on the manifold head 58. Thereafter, when the press head assembly 46 moves upwardly, the springs 146 close the clamps 142 to lock the gassing/press plate 52 onto the mold box 42*a*. Thus, when the mold box 42*a* is rotated to its discharge position in preparation for removing it from the frame 60, the plate 52 is attached thereto and the plate 52 and mold box 42*a* are removed as a single unit from the frame 60.

We claim:

1. A mold transfer mechanism for a molding machine of the type including a frame (25, 27), at least one mold box (42*a*) having a mold cavity for forming a mold (126) therein and means (60, 66) for mounting said mold box (42*a*) on said frame (25, 27) for rotation of said mold box (42*a*) between a molding position and a mold discharge position, comprising:

an elongate mold transfer carriage (84) positioned below said mold box (42*a*) when said mold box (42*a*) is in said discharge position thereof, said mold transfer carriage (84) including first and second sections for respectively supporting first and second molds (126) thereon;

means (76) for transferring a mold (126) from said mold box (42*a*) when said mold box (42*a*) is in said discharge position to one of said first and second sections of said mold transfer carriage (84); and, means (98, 100, 110) for shifting said mold transfer carriage (84) along its longitudinal axis between a first position in which said first section of said transfer carriage (84) is disposed beneath said mold box (42*a*) and said second section is disposed in a first laterally outboard position; and a second position in which said first section of said mold transfer carriage (84) is disposed in a second laterally outboard position and said second section is disposed beneath said mold box (42*a*).

2. The mold transfer mechanism of claim 1, wherein:

said mold transfer carriage (84) includes a plurality of openings (133) therein, and said mold transferring means (76) includes a plurality of mold supporting elements (82) respectively vertically registered with said openings (133) and means (78, 80, 108) for vertically shifting said mold supporting elements (82) between a lowered, standby position beneath said mold transfer carriage (84) and a raised operating position in which said mold supporting elements extend through said openings (133) and engage a mold (126) to be transferred to said mold transfer carriage (84).

3. The mold transfer mechanism of claim 2, wherein said mold transferring means (76) includes a plate (78) on which said supporting elements (82) are mounted and a motor member (80) for vertically driving said support (78).

4. The mold transfer mechanism of claim 1, wherein said mold shifting means (98, 100, 110) includes a table (110), guide means (100, 102) on said table (110) for guiding the movement of said mold transfer carriage (84), and a motor member (98) connected between said mold transfer carriage (84) and said table (110) for driving said mold transfer carriage (84) along said guide means (100, 102).

5. The mold transfer mechanism of claim 1, including means (86, 88, 90, 92) mounted on said mold transfer carriage (84) for cleaning said mold box (42*a*) when said mold box (42*a*) is in said discharge position thereof.

6. The mold transfer mechanism of claim 5, wherein said cleaning means (80, 88, 90, 92) includes means (86) for engaging and sweeping an outer surface of said mold box (42*a*).

7. The mold transfer mechanism of claim 6, wherein said sweeping means (86) includes a rotatable brush (86) and means (88, 90) for rotating said brush (86).

8. The mold transfer mechanism of claim 5, wherein said cleaning means (86, 88, 90, 92) includes means (92) for introducing pressurized air into the mold cavity of said mold box (42*a*).

9. The mold transfer mechanism of claim 8, wherein said means (92) for introducing pressurized air includes an elongate conduit (92) having a plurality of longitudinally spaced openings (141) therein opening toward said mold box (42*a*).

10. The mold transfer mechanism of claim 5, wherein said cleaning means (86, 88, 90, 92) is disposed between said first and second mold supporting sections of said mold transfer carriage (84), whereby said cleaning means (86, 88, 90, 92) is brought into proximity to said mold box (42*a*) when said mold transfer carriage (84) is shifted between said first and second positions thereof.

11. The mold transfer mechanism of claim 10, wherein said cleaning means (86, 88, 90, 92) includes means (86) for sweeping a face of said mold box (42*a*) and means (92) for introducing pressurized air into the mold cavity of said mold box (42*a*).

12. The mold transfer mechanism of claim 1, including at least one set of locating means (114) on said mold transfer carriage (84) for locating the position of said mold box (42*a*) when said mold box is placed on said mold transfer carriage (84) during installation of said mold box (42*a*) on said molding machine.

13. A mold transfer mechanism for a molding machine of the type including a frame (25, 27), at least one mold box (42*a*) having a mold cavity for forming a mold (126) therein and means for mounting said mold box (42*a*) on said frame (25, 27) for rotation between a molding position and a mold discharge position, comprising:

means (84) shiftably disposed beneath said mold box (42*a*) for laterally transferring a mold (126) discharged from said mold box (42*a*) from a first position beneath said mold box (42*a*) to a second position laterally spaced from said first position; and means (86, 88, 90, 92) mounted on said mold transferring means (84) for cleaning away residual molding material from said mold box (42*a*) when said mold box (42*a*) is in said discharge position thereof, said cleaning means (86, 88, 90, 92) being shiftable into proximity to said mold box (42*a*) during transfer of said mold (126) by said mold transferring means (84) between said first and second positions.

14. The mold transfer mechanism of claim 13, wherein said mold transferring means (84) includes a carriage (84) and said mechanism further includes a guide (100) and means (102) for mounting said carriage (84) for sliding movement on said guide (100), said cleaning means (86, 88, 90, 92) being mounted on said carriage (84).

15. The mold transfer mechanism of claim 14, wherein said carriage (84) includes first and second spaced apart sections upon which first and second molds may be respectively supported, and said cleaning means (86, 88, 90, 92) is disposed between said first and second sections.

16. The mold transfer mechanism of claim 13, wherein said cleaning means (86, 88, 90, 92) includes means (86) for engaging and sweeping a surface of said mold box (42*a*).

17. The mold transfer mechanism of claim 16, wherein said sweeping means (84) includes a brush (84).

18. The mold transfer mechanism of claim 17, wherein said cleaning means (86, 88, 90, 92) includes means (88, 90) for rotating said brush (86.)

19. The mold transfer mechanism of claim 13, wherein said cleaning means (86, 88, 90, 92) includes a conduit having at least one aperture therein for delivering pressurized air into said mold cavity.

* * * * *